United States Patent [19]

Vydrin

[11] 4,385,511

[45] May 31, 1983

[54] METHOD OF ROLLING METAL ARTICLES

[76] Inventor: Vladimir N. Vydrin, 28, kv. 27, Chelyabinsk, U.S.S.R.

[21] Appl. No.: 930,408

[22] Filed: Aug. 2, 1978

[30] Foreign Application Priority Data

Aug. 12, 1977 [SU] U.S.S.R. ..... 2507901

[51] Int. Cl.[3] ..... B21B 39/08

[52] U.S. Cl. ..... 72/205; 72/199; 72/366; 72/249

[58] Field of Search ..... 72/199, 205, 366, 249, 72/8, 17, 19

[56] References Cited

U.S. PATENT DOCUMENTS

| | | | |
|---|---|---|---|
| 3,811,307 | 5/1974 | Vydrin et al. | 72/205 |
| 4,145,901 | 3/1979 | Imai et al. | 72/205 |
| 4,145,902 | 3/1979 | Imai et al. | 72/205 |
| 4,173,133 | 11/1979 | Imai et al. | 72/205 |
| 4,365,496 | 12/1982 | Imai et al. | 72/249 |

*Primary Examiner*—Francis S. Husar
*Assistant Examiner*—Jonathan L. Scherer
*Attorney, Agent, or Firm*—Fleit, Jacobson & Cohn

[57] ABSTRACT

The present invention relates to methods of rolling metal articles and can be used to advantage in rolling sheet steel. This method envisages the rotation of drive and driven work rolls in opposite directions at a higher and a lower peripheral speeds, respectively. The chosen ratio between the peripheral speeds of the work rolls is less than the elongation of the article so that thereby the specified unit tension applied to the article at the exit section thereof is provided for with reference to the ultimate strength of the metal emerging from the rolls. This is conducive to increasing the maximum elongation of the article and reducing the roll force by a considerable amount with the constriction of the article in breadth at the same time.

9 Claims, 8 Drawing Figures

METHOD OF ROLLING METAL ARTICLES

The invention relates to the manufacture of metal articles predominantly in the form of wire, tubes, sheet and strip by rolling and can find its application at works turning out such products.

There is known a method of rolling-drawing (RD) metal articles which has been patented in the U.S.A. (Pat. No. 3,811,307) and Great Britain (Pat. No. 1,343,523). This method makes it possible to increase the effectiveness of rolling due to a reduction in the roll force and constraining the breadth of the article with a simultaneous increase in the accuracy of rolling, reduction of power requirements, etc.

The essence of the RD process is that the rolls are caused to rotate in opposite directions at different peripheral speeds, i.e., the rolling is conducted with the mismatch of roller speeds, and a tension $T_1$, for the sake of convenience referred to hereinafter as the front tension, is applied to the article at the exit section thereof. At the same time, the article is induced to travel at a speed $V_1$ at the exit section thereof which is equal to the speed $V_{b1}$ of the drive roll rotating at the higher peripheral speed and a tension $T_o$, referred to hereinafter as the back tension, is applied to the article at the entry section thereof, if necessary. If the RD process, the ratio between the speeds of the rolls is commonly equal to the elongation $\lambda$ of the article, i.e., $V_{b1}/V_{b2}=\lambda$, where $\lambda=h_o/h_1$ and $h_o$ is the thickness of the article in the plane of entry into the zone of deformation and $h_1$ is the thickness of the article in the plane of exit from the zone of deformation.

When the RD process is employed, the no-slip point $K_1$, which is a point where the speeds of the drive roll and article are the same, is located in the plane of exit of the article from the zone of deformation whereas the no-slip point K, indicating equality in the speeds of the driven roll and article, is located in the plane of entry of the article into the zone of deformation.

Under these conditions, existing at the surface of the contact between the article and the driven roll is only the zone of slippage on the entry side and at the surface of the contact between the article and the drive roll, only the zone of slippage on the exit side whereas the friction forces due to contact originating at each of the two rolls and acting on the article are of opposite directions. Namely thanks to that the roll force is reduced by a considerable amount.

The rolling-drawing process can be also operated when the ratio between the roller speeds is greater than the elongation of the article since in this case the single-zone slippage is retained at the opposite contact surfaces in the zone of deformation so that the effect of the friction forces on the pressure is practically eliminated. Under these circumstances, the ratio between the roll speeds need not be maintained so accurately and the control of the rolling-drawing process is consequently simplified.

The RD process is operated by applying a front tension to the article, the magnitude of this tension depending on the amount of deformation and increasing with an increase in the elongation. At a given elongation of the article, the unit tension $\sigma_1=T_1/S_1$, where $S_1$ is the area of the article at the exit section thereof, may increase so as almost to reach the ultimate strength of the metal with a consequent possibility of plastic yield or rupture of that end of the article which emerges from the rolls and will be denoted as the front end. Strip breakage may also occur when the front tension is not as high as indicated above, resulting from a non-uniform distribution of the stresses across the article due to a non-uniform elongation of the article within the breadth thereof so that stresses concentrate in those portions of the article where the elongation is smaller than elsewhere. A disadvantage of the RD process is thus a high front tension which is required to achieve great elongations. Under these circumstances, there is no practical possibility of obtaining the highest elongation by employing the RD process the advantages whereof cannot be thus utilized in full. Yet, the RD process, the advantages and disadvantages whereof have been indicated above, appears to bear a close relationship with the invention disclosed, being the prototype thereof.

It is an object of the present invention to provide a method of rolling metal articles at such ratio between the peripheral speeds of the work rolls which assures the highest possible elongation of the article and the conditions of a low front tension.

An important object of the present invention is a reduction in the roll force while retaining said ratio between the peripheral speeds of the work rolls.

A further object of the present invention is a reduction in the spread of the article.

Still a further object of the present invention is to provide for a more uniform than ever before distribution of the deformation throughout the thickness of the article along with more uniform than ever before mechanical properties throughout said thickness.

Said and other objects are attained by that in a method of rolling metal articles wherein drive and driven work rolls are caused to rotate in opposite directions at a higher and lower peripheral speeds, respectively, and tensions are applied to an article at the entry and exit sections thereof whereby the article is induced to move at a speed which at the exit section thereof is equal to the peripheral speed of the drive roll, due consideration being given to the possible changes in the speed of this roll, in accordance with the invention the rolling is carried out at a ratio between the peripheral speeds of the work rolls which is less than the elongation of the article so that thereby the specified unit tension applied to the article at the exit section thereof is provided for with reference to the ultimate strength of the metal emerging from the rolls.

The solution disclosed eliminates all the disadvantages inherent in the RD process, paving thus the way to obtaining the highest possible elongation of the article in rolling same, and keeps intact the main advantages of the RD process which are considerable reduction in the force and also in the spreading (this applies to the rolling of wire and tubing).

The explanation of the gain thus obtained is that in rolling by the method disclosed the no-slip point of equal speeds of the article and rolls, located when the prototype method is employed in the plane of entry into the zone of deformation, displaces on the driven roll (having a lower speed) in the direction of rolling so as to become located inside the zone of deformation.

This causes a zone of slippage to form on the entry side of the driven roll wherein the friction forces exerted by the roll on the article act in the direction of movement of the article, playing thereby an active part in that they facilitate the progress of the article. By virtue of these friction forces, the tension acting in the same direction and applied to the front end of the article in order to cope with the process of rolling can be reduced, attaining thus the object of reducing the front tension while retaining the specified elongation of the article.

On the other hand, the fact that the front tension can be retained unchanged creates the prospect of increasing the elongation $\lambda$ of the article.

The ratio between the peripheral speeds of the work rolls required in order to carry the method disclosed into practice can be determined from the readings of relevant instruments capable of measuring the front tension $T_1$, the speed $V_1$ of the article at the exit section thereof and the peripheral speed $V_{b1}$ of the drive roll.

In rolling sheet product, the ratio between the peripheral speeds of the drive and driven rolls can be computed, and the mill adjusted for, from the following equation based on the law of conservation of energy:

$$\frac{V_{b1}}{V_{b2}} = \left[1 + \frac{R_2}{h_1}\left(\alpha_{02} - \frac{\sigma_o - \sigma_1 + \xi\sigma_{sm}\ln\lambda}{2\tau_{2a}R_2/h_1}\right)\right]^2 \cos\gamma_2 \quad (1)$$

where $\sigma_1 > 0$ = unit tension applied to the article at the exit section thereof, kg/mm$^2$;

$\sigma_0 \geqq 0$ = unit tension applied to the article at the entry section thereof, kg/mm$^2$, $\sigma sm$ = mean resistance of the metal to deformation, kg/mm$^2$;

$\lambda$ = elongation of the article;

$\xi$ = coefficient allowing for non-uniform and shear deformations;

$\tau_{2a}$ = mean unit friction force in the zone of slippage on the entry side of the driven roll, kg/mm$^2$;

$R_2$ = radius of the driven roll with due allowance for roll flattening, mm;

$h_1$ = thickness of the article in the plane of exit from the zone of deformation, mm;

$\alpha_{02}$ = centre angle corresponding to the point of initial contact of the article being rolled with the driven roll, rad;

$V_{b1}$ = peripheral speed of the drive work roll, mm/s;

$V_{b2}$ = peripheral speed of the driven work roll, mm/s;

$\gamma_2$ = centre angle corresponding to the point of equal speeds of the article and driven roll, rad.

Since Eq.(1) takes into account all the main factors of the rolling process, preliminary computations of the ratio between the peripheral speeds of the work rolls from said equation in the course of designing a mill provide data on the power requirements for the process and allow to formulate optimum conditions of deformation for each particular range of the products rolled.

It is also in accordance with the invention that the rolling is carried out at a torque which is equal to zero at the driven roll, the relationship between the elongation of the article and the unit tensions being maintained to that end with the rest of specified parameters (radius of rolls, friction, thickness of the strip front end, etc.) in accordance with the following equation which is based on the law of conservation of energy:

$$\sigma_1 - \sigma_o - \xi\sigma_{sm}\ln\lambda + \tau_{2a}\frac{R_2}{h_1}\alpha_{02} = 0 \quad (2)$$

This method of rolling allows to dispense with the coupling spindle of the driven roll, simplifying the construction of the mill because one motor, i.e., that of the driven roll is eliminated along with its switchgear when the individual drive is employed and reducing the total power of the motors installed at a stand.

The gain is achieved in this case owing to the fact that the no-slip point $K_2$ is located on the driven roll so that the moment of the friction forces $\tau_{2a}$ in the zone of slippage on the delivery side is equal to the moment of the friction forces $\tau_{2p}$ in the zone of slippage on the entry side. Since the friction forces $\tau_{2a}$ and $\tau_{2p}$ oppose each other in direction, the resultant moment due to their action at the driven roll is equal to zero so that said roll is rotated by the moving strip.

It is further in accordance with the invention that the ratio between the peripheral speeds of the work rolls is increased in response to an increase in the friction force due to contact and decreased when this force decreases. This implies that the specified elongation of the article and the specified front tension are maintained unchanged under the changing conditions of the friction at the surfaces of contact between the article and work rolls, said condition being assured due to the shifting of the no-slip point $K_2$ on the driven roll towards the plane of exit from the zone of deformation by an amount which brings said point inside said plane in an extreme case.

The method of rolling disclosed can be accomplished with different friction forces, i.e., with different coefficients of friction f, coming into play at the surface of contact of the article with the drive roll ($\pi_1$, $f_1$) and that of the article with the driven roll ($\tau_2$, $f_2$).

To reduce the roll force and front tension as much as possible, it is expedient to create such conditions of friction, controlled by lubrication, the magnitude of surface irregularities, etc., which will produce at the drive roll a friction force $\tau_1$ exceeding its counterpart $\pi_2$ at the driven roll.

In accordance with the invention it is also expedient to operate during continuous rolling in one of the zones of deformation at the higher peripheral speed that work roll which is in contact with one side of the article while rotating at the lower peripheral speed is the work roll in contact with the other side of the article whereas in the successive zone of deformation the opposite is the case and so on, whereby the ratio between the peripheral speeds of the work rolls is maintained in every zone of deformation so as to be less than the elongation of the article in same zone.

This technique of rolling is conducive to a more uniform distribution of deformation throughout the thickness of the article and to obtaining more uniform mechanical properties throughout said thickness. The point is that in rolling by the method disclosed the particles in the article which are contiguous with the drive roll are induced to move at a some what higher speed during every pass than the particles contiguous with the driven roll and a consequent non-uniformity of the deformation throughout the thickness of the article is observed, the upper layers of the article being shifted in the direction of rolling relative to the lower layers in the zone of deformation. Any desire to reduce or eliminate said non-uniformity of the deformation can be met by reversing the character of the non-uniformity in the next zone of deformation as envisaged by the technique described hereinabove.

When the method disclosed is used for reversible rolling, in one and the same pair of work rolls, that work roll which is in contact with one side of the article, e.g., the top one, is caused to rotate during one of the passes at the higher speed while the roller in contact with the other, bottom, side is allowed to rotate at the lower speed, the procedure being repeated during the subsequent passes.

Said method of reversible rolling provides for the same gain as the method of continuous rolling described before, the background of the phenomena observed during the reversible and continuous rolling being the same as described above from the standpoint of physics.

It is also in accordance with the invention that, in order to stabilize both the rolling pressure and the thickness of the article at the exit section thereof, the peripheral speed of the driven work roll is decreased and the tension applied to the article at the exit section thereof is increased in response to an increase in the rolling pressure in excess of the specified value whereas the opposite is the case when the rolling pressure decreases below the specified value, whereby the speed of the article at the exit section thereof and the peripheral speed of the drive work roll are maintained the same in both cases. Since the roll force is maintained unchanged by means of relevant adjustment, the above arrangement allows a constant thickness $h_1$ of the article at the exit section thereof to be maintained.

In accordance with the invention it is further that, in order to maintain the ratio between the peripheral speeds of the work rolls smaller than the elongation of the article, the article is impelled to move at a speed which is at the entry section thereof smaller than the speed of the article at the exit section thereof by an amount equal to said elongation. A solution like this one paves the way to higher dimensional accuracy and better workpiece shape control of the article rolled under the conditions of a variable rolling pressure.

All the ways of rolling indicated hereinabove can be carried into practice on any of the known rolling mills capable of providing for different peripheral speeds of the work rolls and equipped with means of providing the requisite tension $T_1$ at the exit section of the article.

The method will be further described with reference to the accompanying drawings, in which.

Figure 1:
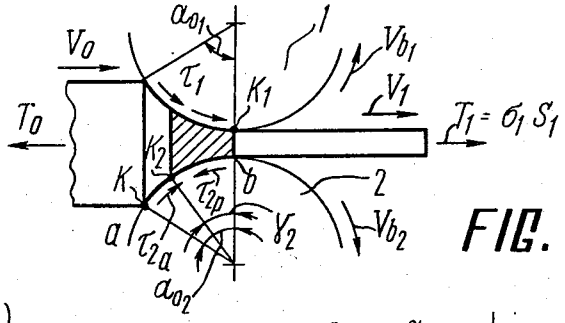
FIG. 1 is a general schematic diagram of the method of rolling in accordance with the invention.

The drawing in FIG. 1 provides explanation to the whole complex of essential features of the invention including those which demonstrate the novelty of the solution offered. In the method according to the invention, as well as in the prototype, the speed $V_1$ of the front end of the article emerging from the rolls is maintained equal to the peripheral speed $V_{b1}$ of the drive roll 1 so that the no-slip point $K_1$, whereat the speeds of the article and the drive roll are the same, is located in the plane of exit of the article from the rolls with the result that slippage in just one zone is assured at the surface of contact with the drive roll, and a tension $T_1$ is applied to the front end of the article emerging from the rolls. By analogy with the prototype, slippage in just one zone at the surface of contact of the article with the drive roll is also assured in the case when the speed $V_1$ of the front end of the article will be smaller than the peripheral speed $V_{b1}$ of the drive roll.

FIG. 1 also depicts the essential features demonstrating the novelty of the method disclosed compared with the prototype, i.e., the driven roll 2 is given a peripheral speed $V_{b2}$ which is smaller than the ratio $V_{b1}/\lambda$ or, in other words, unlike the prototype, the ratio between the peripheral speeds of the rolls is less than the value of $\lambda(V_{b1}/V_{b2}<\lambda)$.

Under such conditions of rolling and providing that $V_1 \leqq V_{b1}$, the no-slip point K at the surface of contact of the article with the driven roll leaves the plane of entry, where it is located in the prototype, and displaces in the direction of movement of the article into a new position $K_2$ with the result that, unlike the prototype, the slippage of the metal relative to the roll occurs now in two zones (on the entry and delivery sides) giving rise to friction forces $\tau_{2a}$ and $\tau_{2p}$ which are of opposing directions in said zones. At the drive roll the no-slip point $K_1$ remains, and so does it in the prototype, in the plane of exit so that on said roll there is retained only one zone of slippage where friction forces $\tau_1$ on the same sign come into play. The friction forces $\tau_{2a}$ in the zone of slippage on the entry side of the driven roll brought about due to the method disclosed are applied to the article, act in the direction of travel of the article and are regarded as playing an active part in that they allow a reduction in the requisite front tension $T_1$, providing thus for the requisite positive result. The resultant $F_{2a}$ of the friction forces $\tau_{2a}$ increases directly with the length of an arc $aK_2$ and inversely with the ratio of the peripheral speeds of the rolls $V_{b1}/V_{b2}$ relative to the elongation of the article.

The relationship between the resultant $F_{2a}$ of the friction forces $\tau_{2a}$ in the zone of slippage on the entry side of the driven roll and the value of the front tension $T_1$ required to cope with the process of rolling depends on the existing conditions under which the deformation of the article takes place.

Figure 2:
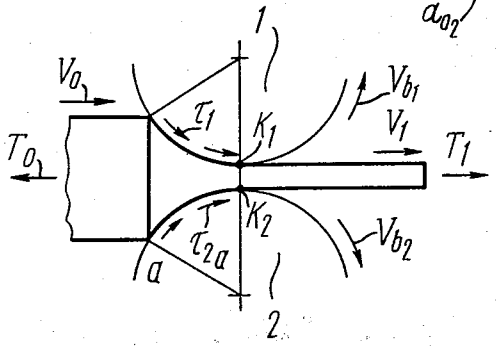
FIG. 2 is a schematic diagram of an embodiment of the method of rolling disclosed wherein the friction due to contact is low.

Illustrated in FIG. 2 is an embodiment of the method disclosed wherein the friction forces $\tau$ at the surfaces of contact between the article and work rolls are reduced while retaining the specified elongation $\lambda$ of the article along with the specified value of the front tension $T_1$ in order to cut the amount of energy consumed in overcoming the friction between the article and rolls and to reduce the wear on the rolls due to said friction. This can be achieved, for example, by improving the surface finish of the rolls by relevant treatment and by using lubricants which reduce the friction forces $\tau$ due to contact. Simultaneously with reducing the friction forces $\tau$ there is the need to increase the peripheral speed of the driven roll with respect to the speed of the drive roller since in this way it is possible to retain the elongation $\lambda$, the tension $T_1$ and the speed $V_1$ of the article at the exit section thereof. In an extreme case, the peripheral speed of the driven roll can be equal to the speed of the article at the exit section thereof, $V_{b2}=V_1$, as indicated in FIG. 2.

Figure 3:
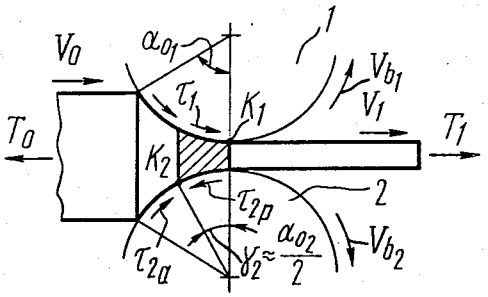
FIG. 3 is a schematic diagram of an embodiment of the method disclosed with only one drive roll.

FIG. 3 illustrates an embodiment of the method disclosed wherein the relationship between the elongation $\lambda$ of the article and the front tension $T_1$ is set so, while maintaining other parameters of the process (radius of rolls, friction, back tension, etc.) as specified, that the no-slip point $K_2$ is located on the drive roll in a position which produces a zero torque $M_{b2}$ at the driven roll and said roll, managing without a drive of its own, obtains rotation from the strip.

Figure 4:
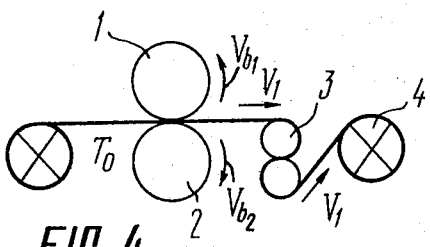
FIG. 4 is a schematic diagram of a mill materializing the method disclosed wherein the speed of the article at the exit section thereof is stabilized by means of strain rolls.
Figure 5:
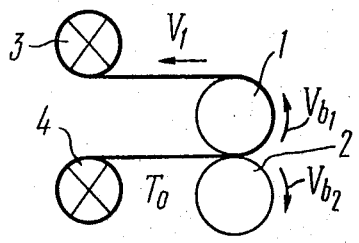
FIG. 5 is a schematic diagram identical with that of FIG. 4 wherein the same purpose is accomplished by enveloping the drive roll with the strip.

When stabilization of the process disclosed is the purpose it is expedient to induce the article to move at a speed which is equal at the exit section thereof to the peripheral speed of the drive roll. This is achievable in a number of ways, for example, by providing a strain unit with rolls 3 (FIG. 4) on the exit side of the stand so that said rolls envelop the article and are caused to rotate by a drive at a peripheral speed equal to the requisite speed $V_1$ of the article at the exit section thereof. A version of a mill constructed on these lines is illustrated in FIG. 4. The article can also be induced to move at a speed which at the exit section thereof is equal to the peripheral speed of the drive roll by enveloping the drive roll with the strip as this is illustrated in FIG. 5 or by any other known methods and means.

To improve both the dimensional accuracy of the article and the workpiece shape control when the rolling pressure is anything but constant, this may be the case when the stand lacks absolute rigidity, it is expedient to induce the article to move at speeds the ratio whereof at the entry and exit sections of said article is equal to the elongation of the article, for example, by providing strain units at the entry and exit sides of the stand with rolls 3 which are enveloped by the article and rotated at the requisite peripheral speed by means of a drive.

Figure 6:
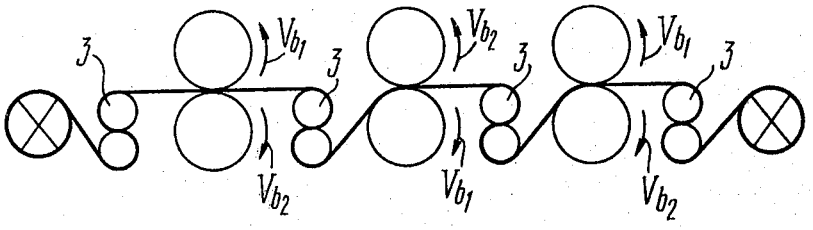
FIG. 6 is a schematic diagram of a mill materializing the method disclosed wherein the speed of the article at the entry and exit sections thereof is stabilized with the aid of strain rolls at every stand.

A mill materializing such method and adapted for continuous rolling is illustrated in FIG. 6.

The mill constructed on the above lines and carrying into practice the method disclosed provides for a higher than ever before accuracy of rolling and allows the longitudinal non-uniformity of the initial strip to be eliminated. To that end, the ratio between the speeds of the article at the entry and exit sections thereof is changed with the aid of the strain rolls 3 so as to keep it in complete agreement with the changes in the value of $\lambda=h_0/h_1$, where $h_o$ is the changing thickness of the article at the entry section thereof and $h_1$ is the specified thickness of the article at the exit section thereof. Should the necessity arise to stabilize (keep constant) the elongation of the article, the ratio between the speeds of the article at the entry and exit sections thereof is maintained constant.

The mill of the layout illustrated by the schematic diagram of FIG. 6 or any other mill of identical construction operating in accordance with the method disclosed appears to be suitable for rolling articles with a variable thickness $h_1$ at the exit section thereof from initial strip of constant thickness $h_o$ at the entry section thereof. This task is coped with by changing the ratio between the speeds of the article at the entry and exit sections thereof in accordance with the law governing the changes in the thickness $h_1$ of the article along the length thereof.

A constant thickness $h_1$ of the article at the exit from the zone of deformation while rolling by the method disclosed can also be maintained by changing the ratio between the peripheral speeds of the work rolls. In this case, the thickness of the article at the exit section thereof will remain constant only if the roll force is stable too.

Yet, any change in the rolling conditions (e.g., the thickness of the initial strip or the rigidity thereof) brings about a change in the rolling pressure. Once can secure the stability of said pressure by, as this is already known, changing the ratio between the peripheral speeds of the work rolls. In the method disclosed, the peripheral speeds $V_{b2}$ of the driven roll must be changed with respect to the peripheral speed $V_{b1}$ of the drive roll so that, if a reduction in the rolling pressure is required, the zone of slippage on the entry side of the driven roll must be contracted in extent by reducing the peripheral speed of said roll with a simultaneous increase in the front tension. To increase the rolling pressure, the peripheral speed of the driven roll must be increased and the front tension decreased at the same time, the speed of the article at the exit section thereof being maintained equal to the peripheral speed of the drive work roll in the course of the above operations.

For workpiece shape (flatness) control and the control of transverse non-uniformity while rolling by the method disclosed the recourse is to forcible bending of one or both work rolls either in the plane of the axes of said rolls or in the plane running at right angles to said plane, using any of the known ways and means.

Figure 7:
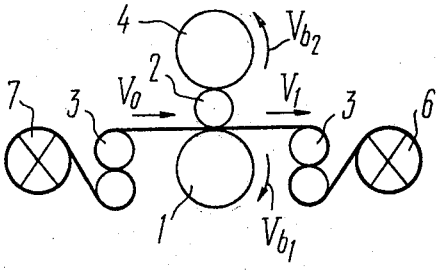
FIG. 7 is a schematic diagram of a mill provided with two work rolls of different diameters and one backup drive roll which operates in conjunction with the driven work roll of the smaller diameter.
Figure 8:
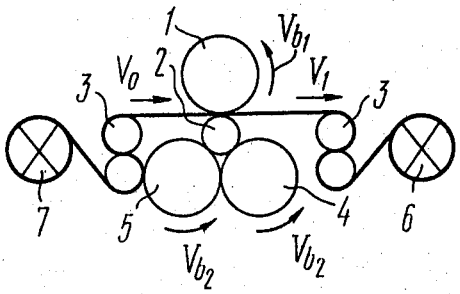
FIG. 8 is a schematic diagram of a mill provided with two work rolls of different diameters and two backup rolls, at least one whereof is a drive roll operating in conjunction with the driven work roll of the smaller diameter.

Depicted in FIGS. 7 and 8 are schematic diagrams of mills for carrying into practice the method disclosed. Said mills incorporate at least one stand with work rolls 1 and 2 of different diameters which provide for a reduction in the roll force owing to the contraction of the contact surface both in length and area. To increase the strength and rigidity, the work roll 2 of the smaller diameter is provided with at least one backup roll 4, and similar backup rolls can be provided at the work roll 1 of the greater diameter, if necessary.

A salient feature of the method disclosed is that the work rolls 1 and 2 are intended to transmit torques which are greater than the torques met with in conventional rolling whereby the drive roll 1, whereon in accordance with the invention only one zone of slippage occurs on the entry side thereof and whereon all the friction forces act in the same direction, transmits a torque which is the maximum possible one in achieving the specified elongation. Said torque is $$M_{b1}=f_1P, \quad (3)$$

where $f_1$=coefficient of friction between the article rolled and the drive roll, and P=pressure applied to the drive roll.

A work roll obtaining rotation through the body of a contacting backup roll is capable of transmitting a torque applied by a drive roll through the contact surface therebetween which is given by $$M_k=f_kP, \quad (4)$$

where $f_k$=coefficient of friction between the drive backup roll and the driven work roll in contact with the first-named roll through the body thereof and P=pressure applied to the drive backup roll.

If the applied pressures P are equal and if $f_k<f_I$, then $M_k<M_{bI}$, denoting that the torque $M_k$ applied to the work roll by the drive backup roll cannot be as high as the torque $M_{b1}$ applied to the work roll by the strip and, consequently, no energy can be transmitted from the drive backup roll to said work roll and thence to the article rolled. If $f_k=f_1$, the rotation of the work roll by the backup one is possible yet the process will be an unstable one. To avoid this, it is preferred to impart rotation to the drive work roll 1 directly by a drive and, taking into account the requirements for twisting strength, it is preferred that the diameter of the work roll 1 is greater than that of the work roll 2 functioning as the driven roll. Since two zones of opposing slippage are formed on the driven roll, the torque $M_{b2}$ applied to said roll is less than the maximum torque (equal to $f_2P$), and we can write that $$M_{b2}<f_kP \tag{5}$$

or $$M_{b2}<M_k. \tag{6}$$

This denotes that no danger exists of slippage between the driven work roll 2 and the drive backup roll 4 imparting rotation thereto. Accordingly, it is preferred, as indicated above, to employ the work roll 1 of the greater diameter as the drive roll and to transmit the torque to said roll directly from the drive by way of a spindle.

The use of a spindle as a means of rotating the work roll 2 of the smaller diameter is inadvisable in the method disclosed, for the neck of said roll may fail to stand to the torque of considerable magnitude transmitted therethrough. This is likely to impose limitations on potential elongations of the article, said limitations increasing with a decrease in the diameter of the driven roll.

In an effort to eliminate said disadvantage, it is preferred to impart motion to the work roll 2 of the smaller diameter through the intermediary of the body thereof and at least one drive backup roll 4 contacting said roll. In this case, the torque is transmitted directly to the backup roll 4 and thence, due to the friction forces, the torque is applied to the work roll 2 of the smaller diameter. This way of actuating the driven roll is a realistic one as this was indicated above. A differentiated approach to the problem of imparting motion to work rolls of different diameters caters for carrying the method disclosed into practice in the most effective way.

The method disclosed can be materialized on other rolling mills such as quarto and multiroll mills (e.g., twenty-roll ones) provided they afford the requisite mismatch of the work roll speeds. However, if functioning as drive rolls on these mills are backup rolls, steps must be taken to prevent the slippage of the drive work roll relative to the drive backup roll contacting same, for example, by additional means of pressing the rolls to each other.

When implementing the method of the present invention, different peripheral speeds of the work rolls are obtainable by providing the working stand with a pinion stand wherein the ratio between the diameters of the mill pinions meet the requirements of Eq.(1). Said group drive is conducive to a reduction in the power requirements of the stand compared with individual drives of work rolls.

If, on the other hand, the working stand has a conventional pinion stand with mill pinions of the same diameter, the peripheral speed of the work rolls being consequently all the same, the ratio between the peripheral speeds computed from Eq.(I) can be obtained by employing work rolls or backup rolls of different diameters.

The disclosed method of rolling provides solution to the problem of reducing the roll force as much as possible under the conditions of a lowermost tension applied to the article at the exit section thereof. By virtue of said distinction the method disclosed compares favourably with the known solutions, offering the following advantages:

1. An increase in the output due to an increase in the reduction per pass under the specified tension applied to the article at the exit section thereof.
2. A reduction in the number of strip breakdowns occurring in rolling and, consequently, a diminishing of metal waste owing to the lowering of the tension used.
3. A decrease in the number of intermediate annealing operations resulting from an increase in the aggregate elongation before annealing and minimized danger of strip breakdown at the same time.
4. A decrease in the minimum possible strip thickness and an increase in the width of the strip rolled.

EXAMPLE

A strip in low-carbon steel with the dimensions $h_o=2$ mm and b=600 mm is to be rolled so as to obtain an elongation $\lambda=2$, using work rolls with a radius $R_2=100$ mm and applying the following unit tensions, $\sigma_1=0.5\ \sigma_{sm}$ and $\sigma_o=0.2\ \sigma_{sm}$, the coefficient of friction being f=0.1 and $\xi=1$. Find the requisite ratio between the peripheral speeds of the work rolls.

The thickness at the exit from the rolls is $$h_1=h_o/\lambda=1 \text{ mm}.$$

The centre angle on the driven roll is $$\alpha_{02}=\sqrt{\frac{\Delta h}{R_2}}=\sqrt{\frac{h_o-h_1}{R_2}}=0.1 \text{ rad}.$$

The requisite ratio between the peripheral speeds is determined from Eq.(1)

$$\frac{V_{b1}}{V_{b2}}=\left[1+100\left(0.1-\frac{0.2-0.5+0.693}{2\cdot 0.1\cdot 100}\right)^2\right]\cdot 1=1.495$$

With the given ratio $\sigma_1/\sigma_{sm}=0.5$ and employing the RD process, the elongation obtainable is $$\lambda=\frac{\sigma_1-\sigma_o}{\rho\sigma_{sm}}=1.495$$

which is considerably smaller than $\lambda=2$, the latter being assured by the method disclosed with the same ratio $\sigma_1/\sigma_{sm}=0.5$. To obtain the specified elongation $\lambda=2$ by the RD process, it is necessary to apply a tension of $\sigma_1/\sigma_{sm}=\ln\lambda+\sigma_o/\sigma_{sm}=0.89$ to the front end of the strip, said tension being by far greater of the specified value $\sigma_1/\sigma_{sm}=0.5$.

What is claimed is:

1. A method of rolling metal articles comprising the following operations: imparting drive and driven rolls rotation in opposite directions at a higher and a lower peripheral speed, respectively; applying to an article disposed between said rolls a tension at the entry and exit sections thereof; inducing the article to move at a speed which at the exit section thereof is equal to the peripheral speed of said drive work roll, due consideration being given to the possible changes in the speed of this latter roll; maintaining a ratio between the peripheral speeds of said work rolls which is less than the elongation of the article so that thereby the specified unit tension applied to the article at the exit section thereof is provided for with reference to the ultimate strength of the metal emerging from the rolls.

2. The method of rolling as claimed in claim 1, wherein the ratio between the peripheral speeds of the drive and driven rolls in rolling sheet metal is chosen from a condition whereunder $$\frac{V_{b1}}{V_{b2}}=\left[\left(1+\frac{R_2}{h_1}\left(\alpha_{02}-\frac{\sigma_o-\sigma_1+\xi\sigma_{sm}\ln\lambda}{2\tau_{2a}R_2/h_1}\right)\right)^2\right]\cos\alpha_2,$$

where $\sigma_1>0$=unit tension applied to the article at the exit section thereof, kg/mm$^2$ $\sigma_o\geqq 0$=unit tension applied to the article at the entry section thereof, kg/mm$^2$;

$\sigma_{sm}$=mean resistance of the metal to deformation, kg/mm$^2$;

$\lambda$=elongation of the article;

$\xi$=coefficient allowing for non-uniform and shear deformations;

$\tau_{2a}$=mean unit friction force in the zone of slippage on the entry side of the driven roll, kg/mm$^2$;

$R_2$=radius of the driven work roll with due allowance for roll flattening, mm;

$h_1$=thickness of the article in the plane of exit from the zone of deformation, mm;

$\alpha_{02}$=centre angle corresponding to the point of initial contact of the article rolled with the driven roll, rad;

$V_{b1}$=peripheral speed of the drive work roll, mm/s;

$V_{b2}$=peripheral speed of the driven work roll, mm/s;

$\gamma_2$=centre angle corresponding to the point whereat the speeds of the article and driven roll are the same, rad.

3. The method of rolling as claimed in claim 2, wherein the rolling is carried out at a torque which is equal to zero at the driven roll, the relationship between the elongation of the article and the unit tensions being maintained to that end in accordance with the equation $$\sigma_1-\sigma_o-\xi\sigma_{sm}\ln\lambda+\tau_{2a}\frac{R_2}{h_1}\alpha_{02}=0.$$

4. The method of rolling as claimed in claim 1, wherein the ratio between the peripheral speeds of the work rolls is increased in response to an increase in the friction forces due to contact and decreased when said forces decrease in order to maintain the specified elongation of the article and the specified tensions.

5. The method of rolling as claimed in claim 1, wherein operated during continuous rolling in one of the zones of deformation at the higher peripheral speed is that work roll which is in contact with one side of the article while rotating at the lower peripheral speed is the work roll in contact with the other side of the article whereas in the successive zone of deformation the opposite is the case and so on.

6. The method of rolling as claimed in claim 5, wherein, in order to stabilize both the rolling pressure and the thickness of the article at the exit section thereof, the peripheral speed of the driven work roll is decreased and the tension applied to the article at the exit section thereof is increased in response to an increase in the rolling pressure in excess of a specified value whereas the opposite is the case when the rolling pressure decreases below the specified value, whereby the speed of the article at the exit section thereof and the peripheral speed of the drive roll are maintained the same in either case.

7. The method of rolling as claimed in claim 6, wherein, in order to maintain the ratio between the peripheral speeds of the work rolls less than the elongation of the article, the article is impelled to move at a speed which at the entry section thereof is less than the speed of the article at the exit section thereof to obtain said elongation.

8. A rolling process for a metal piece maintaining a peripheral velocity ratio between a pair of working rolls as high as possible but below a thickness ratio between the metal piece entering the working rolls and the same metal piece leaving the working rolls, whereby the rolling torque may be within a maximum tolerable torque.

9. A rolling process for a metal piece maintaining a peripheral velocity ratio between a pair of working rolls as high as possible but below a thickness ratio between the metal piece entering the working rolls and the same metal piece leaving the working rolls, whereby the rolling torque may be within a maximum tolerable torque, the magnitude of the torque on a drive roll of the working rolls rotating with the greater speed being the maximum possible under the conditions of the rolling process.

* * * * *